United States Patent [19]

Baumgartner et al.

[11] 4,089,128

[45] May 16, 1978

[54] SMOOTHING OR PRESSING IRON HAVING A SOLE BODY CONSISTING AT LEAST PARTIALLY OF A GLASS MATERIAL

[76] Inventors: Erich Rudolf Baumgartner, Tiroler Platz 4; Peter Doehler, Kaulbachstr. 59, both of Munich, Germany 8000

[21] Appl. No.: 786,511

[22] Filed: Apr. 11, 1977

[30] Foreign Application Priority Data

Apr. 13, 1976 Germany ..... 2616287

[51] Int. Cl.[2] ..... D06F 75/38

[52] U.S. Cl. ..... 38/93; 38/97

[58] Field of Search ..... 38/93, 97, 140, 66, 38/62, 77.83

[56] References Cited

U.S. PATENT DOCUMENTS

| | | | |
|---|---|---|---|
| 2,738,603 | 3/1956 | Towne | 38/93 X |
| 2,846,793 | 8/1958 | Studer | 38/93 X |
| 3,905,138 | 9/1975 | Abolafia | 38/97 |

FOREIGN PATENT DOCUMENTS

| | | | |
|---|---|---|---|
| 1,087,107 | 8/1960 | Germany | 38/77.83 |

*Primary Examiner*—Patrick D. Lawson

*Attorney, Agent, or Firm*—Griffin, Branigan and Butler

[57] ABSTRACT

A smoothing or pressing iron having a sole body consisting at least partially of a glass material wherein the sole body comprises a trough-like or hollow body-like cup or tray of a glass-impregnated woven fabric fleece of heat-proof fibers, and a support structure filling up the cup at the inner side and having a low specific heat and low thermal conductivity. The sole body side facing the goods being ironed is provided with a heating conductor arrangement covered by a thin electrically insulating sole layer. The support body may consist of a foamed synthetic material or a porous ceramic material having low density. The electrically insulating sole layer is a glass-impregnated fabric layer of heat-resistant fibers.

10 Claims, 2 Drawing Figures

SMOOTHING OR PRESSING IRON HAVING A SOLE BODY CONSISTING AT LEAST PARTIALLY OF A GLASS MATERIAL

FIELD OF THE INVENTION

This invention relates to a smoothing or pressing iron having a sole body consisting at least partially of a glass material.

DISCUSSION OF PRIOR ART

A known pressing iron comprises a sole body consisting of glass, via which the heat energy from an infrared radiation source is transferred directly by radiation onto the goods being smoothed or pressed. Experiments made heretofore to heat the sole surface — facing the goods being smoothed — of a sole body consisting of glass by heat transfer from a heat conductor arrangement have been unsuccessful because the glass sole body has a bad thermal conductivity and because, due to the considerable thermal capacity thereof, the same is incapable of sufficiently quickly following the desired temperature variations of the sole surface temperature. Besides, the mechanical strength of the know glass sole body is not sufficient.

SUMMARY OF THE INVENTION

The object of this invention is to solve the problem of constructing a smoothing iron having a sole body consisting at least partly of a glass material so that, along with a high mechanical and electrical strength of the sole surface facing the goods being ironed, a quick response of the temperature of the sole surface to changes in the energy supply to a heating conductor arrangement of the smoothing iron is achieved.

Said problem is solved according to the invention in that said sole body comprises a trough like or hollow body like cup or tray of a glass-impregnated woven fabric or fleece of heat-proof fibers, and a support structure filling up said cup at the inner side and having low specific heat and low thermal conductivity, and in that, on the sole body side facing the goods being ironed, there is provided a heating conductor arrangement covered by a thin electrically insulating sole layer.

In particular, also said electrically insulating sole layer comprises a thin glass-impregnated fabric layer of heat resistant fibers.

Said support body may comprise porous ceramic material having a low density, or foamed synthetic resin.

It will be appreciated that the portions of the sole body or of the sole layer, respectively, adjacent said heating conductor arrangement have a small thermal capacity so that the sole surface with its temperature is extremely quickly responsive to variations of the energy supply to said heating conductor arrangement. Hence the smoothing iron proposed here has necessarily control or regulating means which are precisely and quickly responsive for regulating or controlling the energy supply to the heating conductor arrangement in a manner such that a selected desired temperature of the sole surface is maintained.

Some advantageous embodiments and further developments are subject matter of the attached claims whereto explicite reference is made for the sake of simplification of the description.

BRIEF DESCRIPTION OF THE DRAWINGS

An exemplary emobodiment is elucidated in greater detail hereinafter with reference to the attached drawing in which.

SPECIFICATION OF A PREFERRED EMBODIMENT

Figure 1:
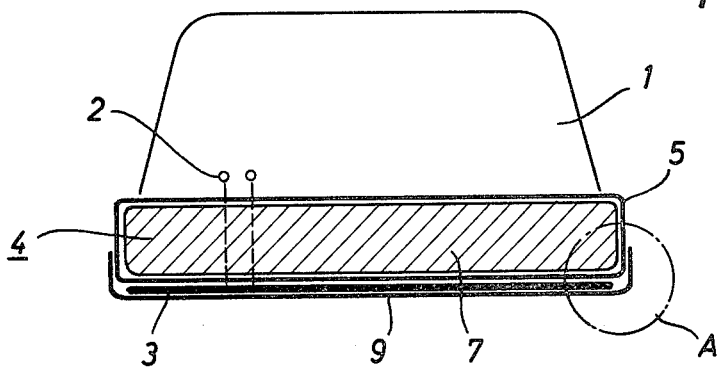
FIG. 1 shows a cross-sectional view of a smoothing iron schematically wherein the structural members located within the smoothing iron housing are omitted.
Figure 2:
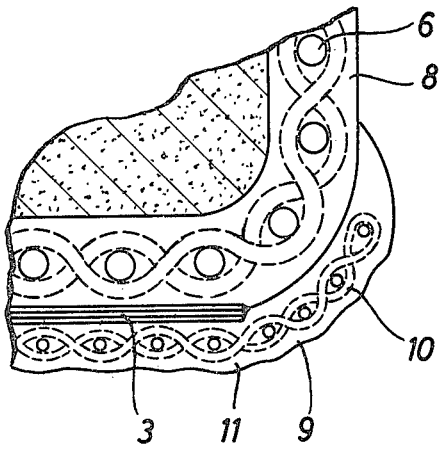
FIG. 2 shows a partial sectional view of the detail designated with A in FIG. 1.

The smoothing iron shown in cross-section in FIG. 1 comprises terminal or connecting means and cntrol or regulating means and control circuits which are provided within a housing 1 and which are in communication with a heating conductor arrangement 3 via connections 2 shown schematically. The heating conductor arrangement 3 is located on the side — facing the goods being ironed — of a sole body 4 comprising a hollow-body-like cup 5 which is boat-shaped in top plan view and consists of a glass-impregnated fabric or of fleece of heat-proof fibers 6, and a support body 7 of polyurethane foam filling up said cup. Said support body may be also comprised of a porous ceramic material having a small density in a manner such that the system formed of cup 5 and support body 7 has a very low thermal capacity, whereon it will be commented hereinafter.

The fibers for forming said cup 5 consist of relatively high-melting glass or of boron carbide and are coated with a glass impregnation 8 which during the manufacture is prepared as a jacket of the fibers 6 for producing the fabric or fleece. When said cup 5 is pressed in a mould at elevated temperature and under increased pressure, the jacket material 8 is softened and closes the pores between the fibers 6 of said fabric completely and produces an only little wavy surface structure at the surfaces of cup 5 by reason of the coated fabric or fleece.

Said heating conductor arrangement 3 is provided as a foil blank or is produced according to a method known from the production of printed circuits, and is arranged on the surface of sole body 4 facing the goods being ironed and is covered by the electrically insulating sole layer 9 which may have a thickness of e.g. 0.5 millimeters. Said sole layer 9 is built up in a similar manner as cup 3 of sole body 4. Accordingly, also sole layer 9 comprises a thin fabric which is made of glass fibers or boron carbide fibers 10 and which has a glass impregnation 11 into which said fabric 10 is also embedded. When, during manufacture, the sole layer is applied to sole body 4 and heating conductor arrangement 3 at elevated temperature and a predetermined pressing rate, the glass impregnation of cup 5 is bonded to the glass impregnation of sole layer 9 so that said heating conductor arrangement 3 is enclosed between sole body 4 and sole layer 9 in a sealed manner.

Due to the small distance — in use — of said heating conductor arrangement 3 from the goods being ironed and due to the high thermal insulating effect of sole body 4, the heat generated by heating conductor arrangement 3 is transmitted in the first place to the goods being ironed while the sole surface can follow quick changes in the adjusted sole temperature whilst also the energy supply to heating conductor arrangement 3 is correspondigly readjusted because due to the low thermal capacity of the portion of the sole body 4 adjacent said heating conductor arrangement a great thermal time constant of the arrangement is avoided. Despite of a comparatively small wall thickness of the hollow body-like cup 5 and of sole layer 9, said members have a great strength which is several times higher than that of corresponding glass hollow bodies which do not contain a fibrous fabric.

What is claimed is:

1. A smoothing or pressing iron having a sole body consisting at least partially of a glass material, wherein said sole body comprises a trough-like or hollow-body-like cup or tray of a glass-impregnated woven fabric fleece of heat-proof fibers, and a support structure filling up said cup at the inner side and having low specific heat and low thermal conductivity, and wherein, on the sole body side facing the goods being ironed, there is provided a heating conductor arrangement covered by a thin electrically insulating sole layer.

2. The smoothing iron according to claim 1 wherein the heat-proof fibers of said sole body consist of glass.

3. The smoothing iron according to claim 1 wherein the heat-proof fibers of said sole body consist of boron carbide.

4. The smoothing iron according to claim 1, wherein said support body consists of foamed synthetic material.

5. The smoothing iron according to claim 4 wherein said foamed synthetic material is polyurethane foam.

6. The smoothing iron according to claim 4 wherein said electrically insulating sole layer is a glass-impregnated fabric layer of heat-resistant fibers, whereby the glass impregnation tightly closes the heating conductor arrangement relative to the sole surface facing the goods being ironed and provides the connection to said sole body.

7. The smoothing iron according to claim 1, wherein said support body consists of a porous ceramic material having a low density.

8. The smoothing iron according to claim 7, wherein said electrically insulating sole layer is a glass-impregnated fabric layer of heat-resistant fibers, whereby the glass impregnation tightly closes the heating conductor arrangement relative to the sole surface facing the goods being ironed and provides the connection to said sole body.

9. The smoothing iron according to claim 1, wherein said electrically insulating sole layer is a glass-impregnated fabric layer of heat-resistant fibers, whereby the glass impregnation tightly closes the heating conductor arrangement relative to the sole surface facing the goods being ironed and provides the connection to said sole body.

10. The smoothing iron according to claim 9 wherein the heat-proof fibers of said sole body and the electrically insulating sole layer consist of glass or boron carbide.

* * * * *